US005586545A

United States Patent [19]

McCaslin

[11] Patent Number: 5,586,545

[45] Date of Patent: Dec. 24, 1996

[54] COMPRESSED GAS GUN

[76] Inventor: John A. McCaslin, 4104 Steeplewood Ct., Arlington, Tex. 76016

[21] Appl. No.: 537,528

[22] Filed: Oct. 2, 1995

[51] Int. Cl.[6] ..... F41B 11/00

[52] U.S. Cl. ..... 124/73; 124/71; 124/70; 124/74; 124/76

[58] Field of Search ..... 124/70, 71, 73, 124/74, 76, 67, 83

[56] References Cited

U.S. PATENT DOCUMENTS

| | | | |
|---|---|---|---|
| 2,817,328 | 12/1957 | Gale | 124/76 X |
| 2,818,056 | 12/1957 | Martin | 124/76 X |
| 3,088,378 | 5/1963 | Boudreau | 124/76 X |
| 3,199,501 | 8/1965 | Bertshinger | 124/76 |
| 3,204,625 | 9/1965 | Shepard | 124/76 X |
| 3,227,148 | 1/1966 | Spack | 124/76 |
| 3,233,600 | 2/1966 | Spack | 124/76 X |
| 3,494,344 | 2/1970 | Vadas et al. | 124/76 X |
| 3,545,008 | 11/1970 | Vadas | 124/76 |
| 4,147,152 | 4/1979 | Fisher et al. | 124/76 |
| 4,336,787 | 6/1982 | Cagnoni | 124/69 |
| 4,531,503 | 7/1985 | Shepard | 124/76 |
| 4,539,969 | 9/1985 | Saxby | 124/57 |
| 4,674,470 | 6/1987 | Tsukiji | 124/74 |
| 4,819,609 | 4/1989 | Tippmann | 124/72 |
| 4,850,330 | 7/1989 | Nagayoshi | 124/76 |
| 4,936,828 | 6/1990 | Dobbins et al. | 124/74 |
| 5,257,614 | 11/1993 | Sullivan | 124/74 X |
| 5,339,789 | 8/1994 | Heitz | 124/56 |
| 5,349,938 | 9/1994 | Farrell | 124/76 X |
| 5,383,442 | 1/1995 | Tippmann | 124/76 |
| 5,497,758 | 3/1996 | Dobbins et al. | 124/76 X |

FOREIGN PATENT DOCUMENTS 137454 9/1952 Sweden .

*Primary Examiner*—Randolph A. Reese
*Assistant Examiner*—Thomas A. Beach
*Attorney, Agent, or Firm*—Daniel R. Brown

[57] ABSTRACT

Two embodiments of a compressed gas gun are disclosed. In the first embodiment, a slidable barrel supported by two barrel guides is employed. A thermoplastic compression sleeve provides a bearing for the slidable barrel, which impacts a valve assembly upon actuation of a trigger mechanism. The impact momentarily opens the valve thereby releasing compressed gas and expelling a projectile. An anti-rebound lock prevents rebound of the barrel and subsequent discharge of gas. In the second embodiment, a slidable bolt assembly serve the function of impacting the valve. The barrel is rigidly attached to the frame of the gun and a spring forces the slidable bolt assembly against the valve. A seal is provided between the slidable bolt assembly and the barrel for allowing slidable movement and preventing the loss of compressed gas.

14 Claims, 9 Drawing Sheets

COMPRESSED GAS GUN

TECHNICAL FIELD OF THE INVENTION

This invention relates to compressed gas guns. More particularly, this invention relates to compressed gas guns having a spring driven moveable member for actuating a compressed gas valve which causes the gun to propel a projectile.

BACKGROUND OF THE INVENTION

Compressed gas guns operate to release a quantity of compressed gas into the breech of a barrel, which has been pre-loaded with a projectile, thereby propelling the projectile out of the barrel at a relatively high velocity. In practice, such a gun must provide a source of compressed gas in order to be operational. Typically, this source of gas is a tank which is pre-charged prior to being coupled with the gun or a fixed tank which is charged in place while coupled to the gun. In either case, the tank holds a finite quantity of compressed gas. Upon discharging the gun one or more times, the reserve of compressed gas is ultimately depleted and must be replenished.

In operation, the breech of the barrel must be accessible for inserting a projectile. If the gun is manually loaded, it is desirable to provide a readily accessible breech which can be conveniently loaded with the fingers of the user.

A valve mechanism is commonly provided which acts to discharge a quantity of compressed gas upon actuation of a trigger mechanism. However, prior to discharging the gun, the valve assembly must be coupled to the breech of the barrel in order to seal the gas port between the tank and the breech of the barrel. It is certainly desirable to provide a tight seal which serves to conserve the amount of gas consumed upon discharging the gun and also to conserve the pressure of the gas so as to maximize the amount of energy transferred from the compressed gas to the projectile. Furthermore, a tight gas seal reduces the sound level of the gun upon discharging, which is desirable in compressed gas guns.

The quantity of parts, particularly precision parts, is a factor in the cost of producing a compressed gas gun. Accuracy and repeatability of the projectile trajectory, upon firing, are desirable in compressed gas guns. Precision components and accuracy often go hand in hand. While some users view compressed gas guns as a sort of toy, there is a segment of the compressed gas gun market which demands the highest possible level of accuracy and performance in such guns. Indeed, compressed gas guns are used in competitive, hunting and other sporting events where accuracy, efficiency, and durability are of utmost importance. Compressed gas guns offer advantages over conventional fire arms, including the lack of any need for an operator's license, low operating cost, and quiet operation.

Various compressed gas guns have been proposed which accomplish the foregoing tasks involved in discharging such a gun. Many of the proposed designs utilize a large quantity of precision parts to produce a high quality gun. Often times, the trigger mechanism, valve assembly, and breech seal require the majority of precision parts. If a compromise is made in the quality of the design or parts, gun quality usually suffers.

The vast majority of compressed gas guns utilize a barrel which is rigidly fixed to the frame of the gun. This is viewed as desirable because the hand grips, barrel, and aiming sights are rigidly fixed in relation to each other. This is believed to provide a gun with repeatable accuracy. However, such guns do not lend themselves to a design which provides both a readily accessible breech and a tight seal in the compressed gas circuit. In order to accomplish this, a complex mechanism if often required, which usually increases the cost and decreases the durability and reliability of such guns.

A gun has been proposed which incorporates a movable barrel that is driven against a valve assembly upon actuation of a trigger mechanism. A cylindrical barrel is provided that includes a breech opening cut into the side of the barrel, near the breech end of the barrel. A valve stem extension is employed which extends a sufficient length out from the valve assembly so as to reach into the rear of the barrel a sufficient distance to pass the breech opening when the barrel is driven rearward to actuate the valve assembly. The gun suffers from several disadvantages which reduce the accuracy, efficiency, convenience, and reliability of the design.

Since the breech is cut into the side of the barrel and since compressed gas guns are usually of small caliber, it is difficult and inconvenient to load a projectile into the barrel. The cylindrical barrel is movable within a cylindrical opening formed into the frame of the gun. In order to provide ease of movement, the tolerance between the two must be loose, thereby allowing lateral play and reducing the accuracy of any gun of such design. The gas seal between the valve stem extension and the barrel is an 'O'-ring which must slide against the bore of the barrel for most of the length of movement of the barrel, including sliding past the beech opening. This movement, combined with the lateral play of the barrel results in a seal which is prone to leakage, thereby increasing the quantity of compressed gas consumed and reducing the effective energy transfer from the compressed gas to the projectile. Further, gas leaks tend to increase the sound level of the gun upon discharging.

Another disadvantage of the prior art moveable barrel design is the tendency of the barrel to rebounds after actuating the valve assembly. When the barrel rebound after discharging, it re-impacts the valve assembly and may cause a subsequent actuation and release of gas, thereby wasting compressed gas and further increasing the sound level of the gun.

Clearly there is a need for a compressed gas gun which improves upon prior designs. Such a gun would offer ease of loading, quiet operation, accuracy, efficiency, and reliability. Further, such a gun would comprise relatively few parts, particularly precision machined parts, while still offering the foregoing advantages.

SUMMARY OF THE INVENTION

The present invention is a compressed gas gun which offers several advantages over prior art designs. Two embodiments are disclosed which practice the advantages discussed hereinafter. Both guns operate utilizing an easily accessible open breech design that provides for easy loading of the gun. Both provide an impact actuated valve assembly with an anti-rebound lock mechanism that prevents subsequent discharge of compressed gas. Both offer tight valve to breech sealing that improves efficiency and provide quiet operation. Both offer smooth operation and accurate barrel alignment for improved accuracy and repeatability. Both are constructed with relatively few parts, as compared to conventional designs, and in particular, a minimum of precision parts. Thermoplastics are used to advantage. Common parts are used to generally provide for economies of scale for mass produced products.

In the first embodiment, a rigid frame is provided that supports two barrel guides, a valve assembly, and a trigger assembly. The barrel, which has a breech opening at its breech end, is slidably mounted to the frame by the two barrel guides. A spring is disposed between the frame, by one of the barrel guides, and the barrel, by a cocking pawl which is rigidly attached to the barrel. The barrel is biased by the spring and thus urged toward the breech end of the frame. A cocking knob is also attached to the barrel, by the cocking pawl, and extends outside the frame for easy cocking of the gun. A trigger assembly engages the cocking pawl and retains the barrel away from the breech end of the frame, ready for actuation and subsequent discharge.

A valve assembly is connected to the frame, at the breech end thereof and in line with the bore of the barrel. When the trigger mechanism is actuated, the cocking pawl is disengaged and the spring forces the barrel toward the breech end of the frame. The breech of the barrel impacts the valve assembly, which is spring biased in a closed position, and forces the valve assembly to discharge compressed gas from a compressed gas tank which is connected to an inlet fitting on the valve assembly. The gas is discharged out of a vent port in the valve assembly and into the breech of the barrel. A seal is provided between the vent port and the barrel beech which prevents the escape of compressed gas, other than through the barrel itself. After the barrel impacts the valve assembly, it naturally rebounds toward the muzzle end of the frame, although not far enough for the trigger assembly to re-engage the cocking pawl. If left unattended, the barrel might re-impact the valve assembly and cause a subsequent discharge of wasted gas. To prevent this occurrence, the present invention provides an anti-rebound lock, disposed between the barrel and frame, which locks the barrel on its first rebound and prevents subsequent gas discharge.

In the preferred embodiment, the frame includes a receiver tube that has a breech opening formed into it at a position so that the user of the gun can easily access the breech of the barrel and insert a projectile when the gun is cocked. A receiver tube diameter is selected that also provides adequate size for easy insertion of the projectile. The inside diameter of the receiver tube provides the support surface for the barrel guides. In general, the barrel and receiver tube are concentric to one another.

As was discussed earlier, the prior art guns having moveable barrels suffered from poor barrel alignment and therefore, poor accuracy. One proposed solution is to provide a precisely machined cylindrical opening in the frame or receiver tube to precisely guide the barrel as it is moved in a direction parallel to its bore. However, upon repeated operation or with poor lubrication of the mechanism, the would be subsequent wear which would gradually decrease the accuracy of the gun.

The present invention discloses a barrel guide the overcomes problems known in the prior art. A thermoplastic compression sleeve is disposed around the barrel to act as a bearing and support the barrel, but allow slidable movement of the barrel in a direction parallel to its bore. A thermoplastic material having good lubricity characteristics is preferred. Because the thermoplastic material may wear over repeated use, a radial biasing means is provided that provides radial force against the outside of the barrel bushing, and against the barrel. This biasing means can be a spring or other device suitable for providing radial force. In the preferred embodiment, one or more 'O'-rings are used. The 'O'-ring can be made from neoprene or other rubber-like material. Thus, the biasing means, and the natural characteristic of the thermoplastic material to be formed, allow any slack caused by wear to be reduced by the force of the radial biasing means.

To complete the barrel guide assembly, a housing is provided that is rigidly attached to the frame, at the receiver tube, and serves to support the radial biasing means and the barrel compression sleeve. In addition, one or more washers and a clip ring are utilized to hold the compression sleeve in place.

The trigger assembly is of conventional design, utilizing a sear mechanism that engages the cocking pawl.

Two different valve assemblies are disclosed, however, other designs could be employed. In the first valve assembly, a plunger is provided that moves within a housing and is biased toward the breech of the barrel by a spring. A gas port is connected between the plunger and a valve at the rear of the valve assembly. The valve closes against the housing inlet. The valve assembly is treaded and connects directly to the tank. In operation, the breech of the barrel impacts the plunger, thereby forcing the valve open. As the barrel recoils, the spring in the valve assembly, and the force of the compressed gas, hold the plunger against the barrel, providing a sealed closure between the two. The plunger includes an 'O'-ring which aligns with the barrel and provides a pliable seal thereto. As the barrel rebounds away from the plunger, the valve re-closes and prevent subsequent loss of compressed gas.

The second valve assembly utilizes a gas port having a vent port formed therein, and a valve formed thereon. The valve closes against a housing at the inlet end of the valve assembly. The gas port is biased by a spring to maintain the valve in a closes position. The barrel impacts the gas port directly, or the gas port may have a thermoplastic seal attached to its discharge end for sealing to the barrel upon discharge. This seal is also called a vent port. To prevent the escape of compressed gas along the outside diameter of the gas port, a thermoplastic compression sleeve, similar to that used in the barrel guide is employed. A radial biasing means, such as one or more 'O'-rings maintains a tight seal between the gas port and the housing. The 'O'-ring also serves to seal against the loss of gas.

In the second embodiment of the compressed gas gun, a fixed barrel is employed together with a slidable bolt assembly. In this embodiment, the slidable bolt assembly slides in a direction parallel to the bore of the barrel. A spring is disposed between the frame and the slidable bolt assembly which urges the slidable bolt assembly toward the breech end of the frame. The slidable bolt assembly impacts the valve assembly in a similar fashion to the breech of the barrel in the first embodiment. The slidable bolt assembly also includes a cocking pawl, in the form of a machined slot in the slidable bolt assembly, which is engaged by the trigger assembly to hold the slidable bolt assembly in a cocked position. The elements are configured such that when the slidable bolt assembly is cocked, the breech end of the barrel is exposed an accessible through the breech opening in the receiver tube for easy loading of the gun. When the trigger assembly is actuated, the slidable bolt assembly is urged rearward, against the valve assembly, thereby discharging the gun.

The slidable bolt assembly is sealed to the barrel and against gas leakage by a thermoplastic compression sleeve similar in configuration to the thermoplastic compression sleeve used in the second valve assembly embodiment.

The second embodiment of the compressed gas gun also includes an anti-rebound lock mechanism to prevent subsequent gas discharge.

BRIEF DESCRIPTION OF THE DRAWINGS

The features of the present invention which are believed to be novel are set forth with particularity in the appended claims. The invention, together with further objects and advantages thereof, may be best understood by making reference to the following description taken in conjunction with the accompanying drawings, in the several figures of which like reference numerals identify identical elements, and wherein:

DETAILED DESCRIPTION

Figure 1:
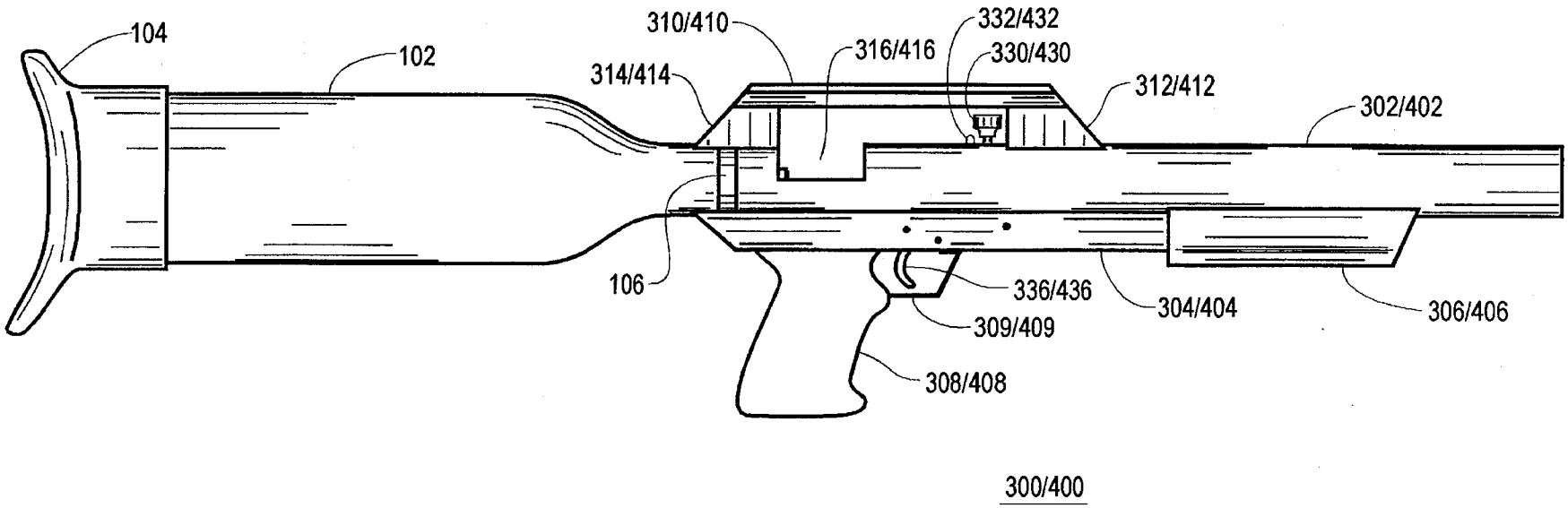
FIG. 1 is a side view of the first and second embodiments of the gun.

Reference is directed to FIG. 1 which is a side view depicting both the first and second embodiments 300/400 of the present compressed gas gun invention. Several components are assigned dual numbers in this view because these elements are identical in both embodiments and the element numbers will be distinguished in the subsequent detailed views of both embodiments.

Both embodiments employ a frame which comprises an aluminum receiver tube 302/402 and an aluminum 'C'-channel frame rail 304/404 which are attached with screws. While aluminum is used in the preferred embodiments, any suitable material could be substituted. A forestock 306/406 is attached to receiver tube 302/402 and a pistol grip 308/408 is attached to frame rail 308/408 to provide convenient hand holds for the user. Generally, the muzzle end can be referred to as the front of the gun and the breech end can be referred to as the rear of the gun.

A combination breech guard and accessory mounting rail including a front mount 312/412, a rear mount 314/414, and a mounting rail 310/410 is connected to the receiver tube 302/402. The breech guard acts as a guard to protect the breech opening 316/416 formed in the receiver tube and as a convenient carrying handle. Within the space formed between the receiver tube 302/402 and the breech guard are located the cocking knob 330/430 and the anti-rebound lock 332/432, which will be described in detail hereinafter.

A trigger 336/436 extends from frame rail 304/404. The trigger 336/436 is protected by trigger guard 309/409 which is connected between pistol grip 308/408 and frame rail 304/404.

Connected to the breech end of the receiver tube 302/402 is a valve assembly 106. There are two different valve assemblies disclosed in the present invention and more detail of these valve assemblies will be described hereinafter. The valve assembly serves to connect the breech end of the receiver tube 302/402 and the compressed gas tank 102. The compressed gas tank serves as the stock of the gun and is fitted with a suitable buttstock 104 which serves as a comfortable shoulder rest to the user.

Figure 2:
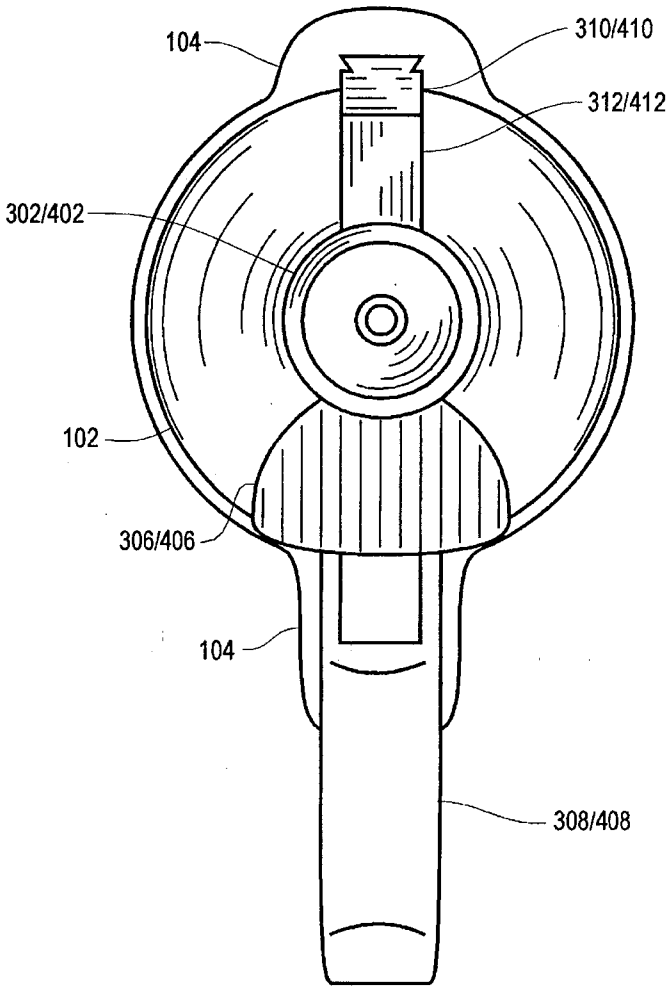
FIG. 2 is a muzzle end view of the second embodiment of the gun.

FIG. 2 is a muzzle end view of both embodiments of the present invention. Receiver tube 302/402 is at the center with forestock 306/406 and trigger guard 309/409 visible below. Beyond trigger guard 309/409 is pistol grip 308/408. Above the receiver tube 302/402 is seen the front support 312/412 and mounting rail 310/410 of the breech guard. Beyond receiver tube 302/402 is the compressed gas tank 102 and buttstock 104.

Figure 3A:
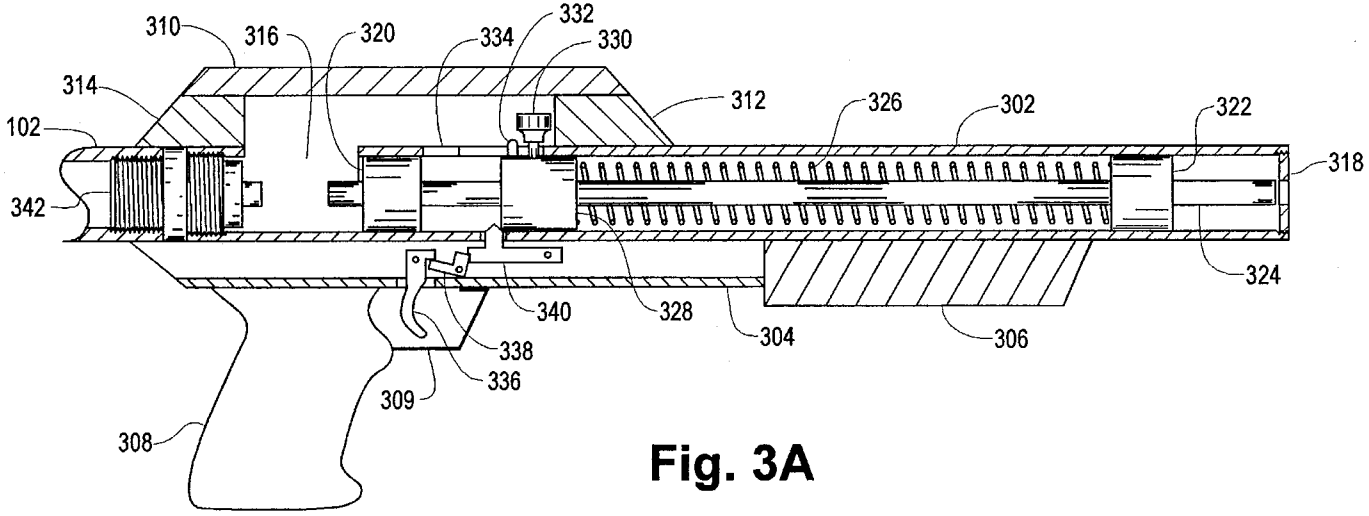
FIG. 3A is a section view of the first embodiment of the gun in the cocked position.
Figure 3B:
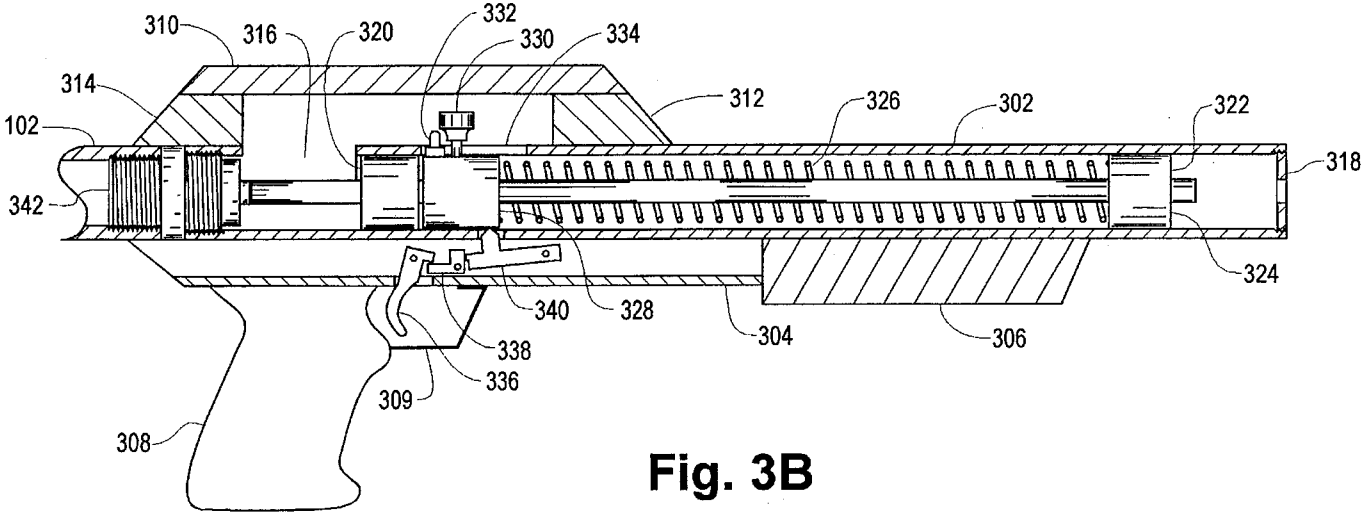
FIG. 3B is a section view of the first embodiment of the gun at the moment of discharge.

FIG. 3A and 3B are cross sections, along the side, of the first embodiment of the present invention. Generally, this cross section is taken at the centerline of the gun, except that the major internal components that are illustrated in subsequent detailed views, are shown in assembled form.

Referring to FIG. 3A, a receiver tube 302 serves as the foundation of the frame by supporting frame rail 304, forestock 306, muzzle plate 318, and the breech guard comprising front support 312, rear support 314, and mounting rail 310. In addition, valve assembly 342 is threaded and screwed into the breech end of receiver tube 302. Within receiver tube 302 are attached a front barrel guide 322 and a rear barrel guide 320. The front barrel guide 322 can be located at a suitable location that is closer to the muzzle end of the gun than the location of the rear barrel guide 320. Likewise, rear barrel guide 320 can be attached at any suitable location so long as it is closer to the breech end of the gun that front barrel guide 322.

The barrel 324 is supported by the front barrel guide assembly 322 and the rear barrel guide assembly 320 and is slidably mounted so as to slide in a direction substantially parallel to the bore of the barrel 324. Along barrel 324 is a cocking pawl 328 which is rigidly attached thereto. The cocking pawl 328 retains one end of spring 326. The other end of spring 326 is retained by and located with respect to the frame by front barrel guide assembly 322. The spring 326 biases a force against cocking pawl 328 and thereby urges the cocking pawl 328 and barrel 324 toward the breech end of the gun. The breech of barrel 324 impacts valve assembly 342 when the spring 326 is fully extended.

A cocking knob 330 is connected to cocking pawl 328 and provides a means to manually slide the barrel 324 against the force of the spring 326. An elongated opening 334 is machined into receiver tube 302, through which cocking knob 330 extends, thereby giving access to the cocking knob 330. A trigger assembly including a trigger 336, a sear link 338, and a sear catch 340, are provided to retain the gun in a cocked position. Sear catch 340 is spring biased (not shown) in an upward direction so that as cocking pawl 328 is manually pushed toward the muzzle end of the gun by cocking knob 330, the sear catch 340 raises up to engage cocking pawl 328. Simultaneously, sear link 338 rotates under spring force (not shown) to engage the sear and set the trigger 336 for subsequent discharge of the compressed gas gun.

While the gun is cocked, as is depicted in FIG. 3A, the user inserts a projectile, such as a lead pellet or BB, into the breech of the barrel by reaching into the breech opening 316 which is formed into receiver tube 302.

When the trigger 336 is actuated, the sear link 338 is rotated thereby releasing sear catch 340 which is forced downward by the incline plane machined onto the sear catch 340 by the cocking pawl which is under force of the spring 326. This action allows spring 326 to drive the cocking pawl 328 and the barrel 324 toward the breach end of the gun.

Now referring to FIG. 3B, which depicts the same view as FIG. 3A except the gun is shown in a position just at the moment of gas discharge. The spring 326 has urged the barrel 326 toward the breech of the gun and the breech of the barrel has impacted the valve assembly and caused the valve to open, thereby discharging compressed gas into the breech of the barrel. The barrel 324 rebounds toward the muzzle end of the gun, partially as a result of the force exerted against it by the valve assembly. Details of the valve assembly will be described hereinafter. As the barrel 324 rebounds, the valve assembly closes, stopping the discharge of gas before the barrel disengages the valve assembly. This action prevents gas from escaping and being wasted.

If left unattended, the barrel may rebound and oscillate prior to coming to rest and cause subsequent impacts against valve assembly 342 and thereby causing subsequent gas discharge. To prevent this, the present invention includes a anti-rebound lock 332. The anti-rebound lock 332 is inserted into an opening formed in cocking pawl 328 and is spring biased in an upward direction. The elongated opening 334 in the receiver tube 302 guides the anti-rebound lock as the barrel slides. The elongated opening has a narrow portion and an enlarged portion. More detail of this opening is described hereinafter. As the cocking pawl 328 moves toward the breech end of the gun, the spring which biases the anti-rebound lock causes the anti-rebound lock 332 to move upward when the elongated opening allows. Then, upon rebound of the barrel 324 and cocking pawl 328, the anti-rebound lock limits the travel of the barrel toward the muzzle end of the gun, preventing oscillation and subsequent gas discharge.

When the user desires to cock the gun, the anti-rebound lock 332 is depressed manually while the cocking knob 330 is pushed toward the muzzle end of the gun. This action releases the anti-rebound lock 332 and allows manual cocking of the gun.

The valve assembly 342 includes a threaded inlet fitting to which tank 102 is connected. Compressed gas flows from the tank 102 through the valve assembly 342 and into the breech of the barrel 324 upon discharge of the gun.

Figure 4A:
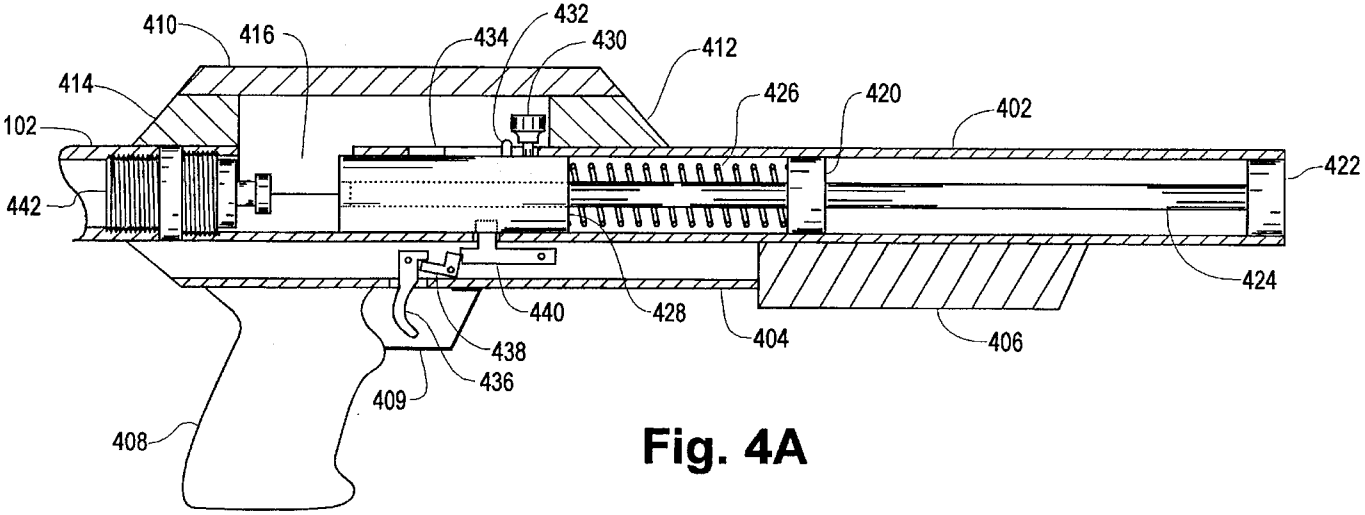
FIG. 4A is a section view of the second embodiment of the gun in the cocked position.
Figure 4B:
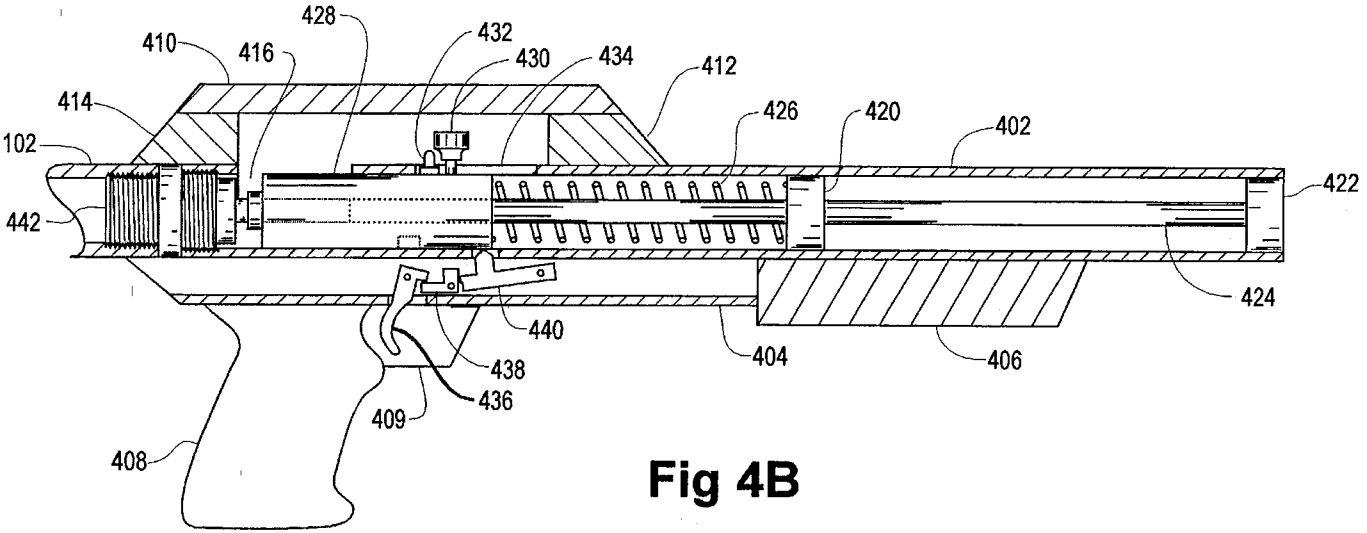
FIG. 4B is a section view of the second embodiment of the gun at the moment of discharge.

Reference is now directed to FIG. 4A and 4B which depict the second embodiment of the present invention. Both of these figures are a section view, along the side of the gun, generally taken at the centerline of the gun, except that the major internal components that are illustrated in subsequent detailed views, are shown in assembled form.

In FIG. 4A, the frame includes receiver tube 402 and frame rail 404 which are attached by screws. In addition, forestock 406 is connected to receiver tube 402 and pistol grip 408 is connected to frame rail 404. A trigger guard 409 is connected between pistol grip 408 and frame rail 404. A breech guard, including front support 412, rear support 414, and mounting rail 410, is attached to receiver tube 402. A trigger guard 409 is connected between pistol grip 408 and frame rail 404.

A barrel 424 is rigidly attached to receiver tube 402 by a front mount 422 and a rear mount 420. The locations of these mounts is not critical, however, barrel 424 should be substantially concentric with receiver tube 402. A slidable bolt assembly 428 is slidably mounted on the breech end of barrel 424. A detailed view of slidable bolt member 428 is described hereinafter. The slidable bolt assembly 428 is biased toward the breech end of the gun by spring 426. The spring 426 is retained, with respect to the frame, by barrel mount 426 and exerts force directly against slidable bolt assembly 428, thereby urging the slidable bolt assembly 428 rearward. While the gun is cocked, as is depicted in FIG. 4A, the user inserts a projectile, such as a lead pellet or BB, into the breech of the barrel by reaching into the breech opening 416 which is formed into receiver tube 402.

The slidable bolt assembly 428 is machined to include a cocking pawl as in the first embodiment for engaging the sear catch 440 in the trigger assembly. A cocking knob 430 extends from the slidable bolt assembly 428 and extends through an elongated opening 434 in the receiver tube 402. As in the first embodiment, the cocking knob allows manual cocking of the gun. The operation of the trigger assembly is the same as in the first embodiment. Trigger 436 and sear link 438 corresponding to elements 336 and 338 in the first embodiment.

Upon actuation of the trigger, sear catch 440 is released and is forced downward by the force exerted by spring 426 against the slidable bolt assembly 428 against the incline plane formed in the sear catch 440. The slidable bolt assembly slide toward the breech end of the gun and impacts the valve assembly 442, thereby actuating the valve and causing the release of compressed gas into the breech end of slidable bolt assembly 428. The gas move through the slidable bolt assembly and into the breech of barrel 424, thereby forcing a projectile out of the muzzle of the barrel 424.

A spring in valve assembly 442, and the natural rebound of the slidable bolt assembly force the slidable bolt assembly 428 back toward the muzzle end of the gun after the gas is expelled, and this action closes the valve assembly to stop the release of compressed gas. Upon actuation of the trigger and the sliding movement of the slidable bolt assembly 428, a anti-rebound lock 432, which is spring biased upward, is forced into a wide portion of opening 434. This action does nothing to impede the rearward movement of the slidable bolt assembly 428. However, upon recoil of the slidable bolt assembly 428, the extended anti-rebound lock 432 will not slide forward past the wide portion of opening 434. Thusly, the anti-rebound lock 432 engages the opening 434 and prevents further movement of slidable bolt assembly 428. This action prevents the recoil and subsequent impact of the slidable bolt assembly 428 against valve assembly 442, which if left unimpeded, could cause subsequent discharge of compressed gas.

Figure 5:
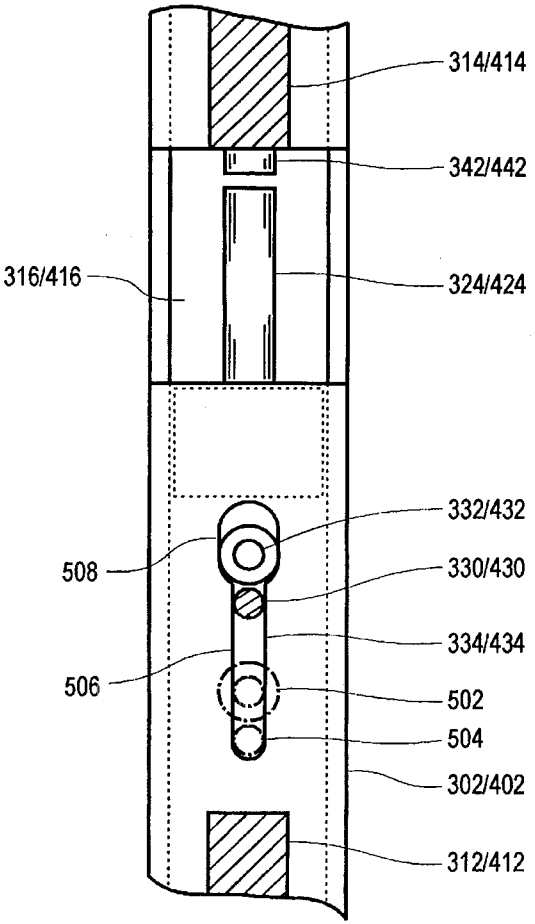
FIG. 5 is a section view detailing the anti-rebound lock in the preferred embodiment.

Reference is directed to FIG. 5 which is a section view, looking down from a plane just above the receiver tube in the area of the breech opening, anti-rebound lock, and cocking knob. Visible, in section are the breech guard font support 312/412 and rear support 314/414. Breech opening 316/416 is visible and exposes barrel/slidable bolt assembly 324/424 and the discharge end of valve assembly 342/442. The position on these elements is shown after discharge of the gun and before cocking for subsequent discharge.

Lock opening 334/434 is visible and is subdivided into an elongated portion 506 and a wide portion 508. The stem of cocking knob 330/430 is shown in section and extends through the lock opening 334/434. Anti-rebound lock 332/432 extends through the lock opening and is shown in position where the anti-rebound lock 332/432 has engaged the shoulder of the transition between the wide portion 508 and the elongated portion 506 of lock opening 334/434. Since anti-rebound lock 332/432 is spring biased upward, the gun cannot be cock until the anti-rebound lock 332/432 is manually depressed allowing the cocking knob to be actuated and urged against the force of the main spring (not shown). For reference, the position of the anti-rebound lock 332/432 and cocking knob stem 330/430 are shown with broken lines at positions 502 and 504 which is the cocked position.

Upon actuation of the trigger, the cocking pawl in the first embodiment, or the slidable bolt assembly in the second embodiment are driven toward the breech end of the gun and thus force the anti-rebound lock in motion together. As the anti-rebound lock 332/432 enters the wide portion 508, a spring urges the anti-rebound lock 332/432 up and into the wide portion 508. Wide portion 508 is extended toward the breech end of the gun so as to allow movement of the barrel or slidable bolt assembly rearward far enough to actuate the valve assembly 342/432.

Figure 6C:
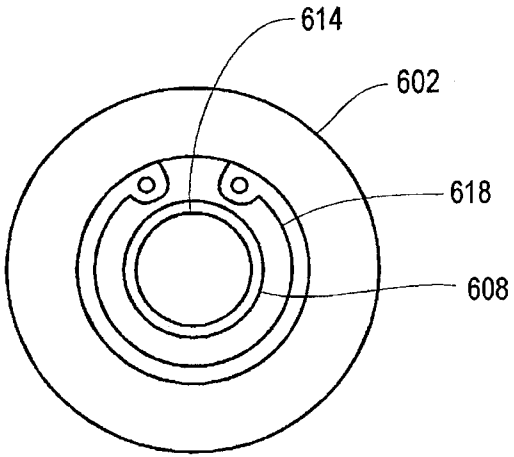
FIGS. 6A, 6B, and 6C are details of the barrel guide in the first embodiment.
Figure 6A:
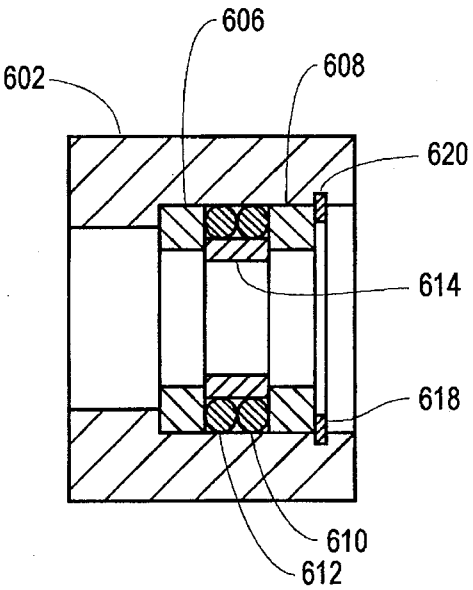
Figure 6B:
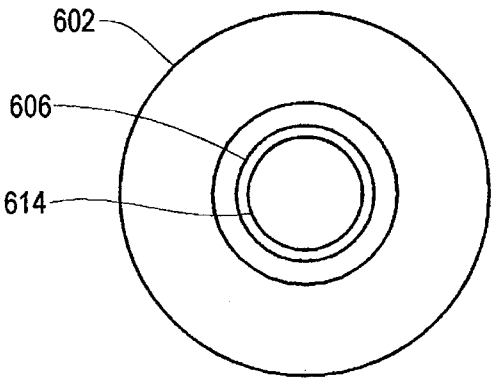

Reference is directed to FIGS. 6A, 6B, and 6C which are details of the preferred embodiment of the barrel guide assembly 320 and 322 in the first embodiment of the present invention as seen in section view 6A and end views 6B and 6C. Housing 602 is machined from a cylindrical block of aluminum. The outside diameter is substantially the same as the inside diameter of the receiver tube and is held in position by screws (not shown). The housing 602 has a hole bored through its longitudinal axis which has a first and second diameter thereby forming a shoulder at the change in diameter.

A washer 606 is inserted into the larger diameter hole and is retained in position by the shoulder. Two 'O'-rings 610 and 612 are positioned in the hole and are positioned one against the other and against washer 606. A compression sleeve 614 which is cylindrical in form and preferably made of Teflon is positioned circumfrentially within 'O'-rings 606 and 608. The barrel, not shown, is supported by the inside diameter of compression sleeve 614. The arrangement of diameters of the 'O'-rings, compression sleeve 614 and the barrel, not shown, is such that the 'O'-rings exert a radial compression force against the barrel and thereby hold the barrel in position. The natural lubricity of the Teflon allows the barrel to slide freely while still being maintained in radial position as it slide through the compression sleeve. This structure provides good accuracy and repeatability of the projectile trajectory upon repeated operation of the gun.

While Teflon is the preferred material for compression sleeve 614, other thermoplastic materials which afford good lubricity characteristics could also be employed to obtain the desired results.

A second washer 608 is inserted into the hole in housing 602 and serves to retain the 'O'-rings and compression sleeve 614. Finally, a clip ring 618 is position into and annular groove 620 machined into the housing 602. The clip ring 618 serves to retain the entire assembly as one.

Referring to FIGS. 6B and 6C, it can be seen that the smallest inside diameter of all the components in the barrel guide assembly is the compression sleeve 614. This arrangement provides that the barrel is supported by the compression sleeve exclusively. The compression sleeve 614 may be split to allow for adjustment of its diameter to fit barrels of slightly different outside diameter and also to aid in the assembly of the gun. The need to split the compression sleeve 614 is dependent on the natural cold flow characteristic of the thermoplastic used for compression sleeve 614. If the thermoplastic used has good cold flow characteristics, such as Teflon, then the split may not be necessary. Conversely, if the thermoplastic used does not exhibit good cold flow characteristics, then a split in the compression sleeve 614 is useful to allow the 'O'-rings to exert the desired compression force against the barrel.

Figure 7B:
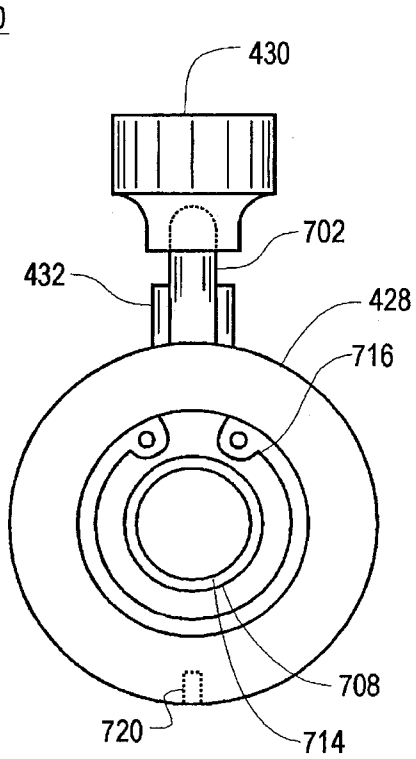
FIGS. 7A and 7B are details of the slidable bolt assembly in the second embodiment.
Figure 7A:
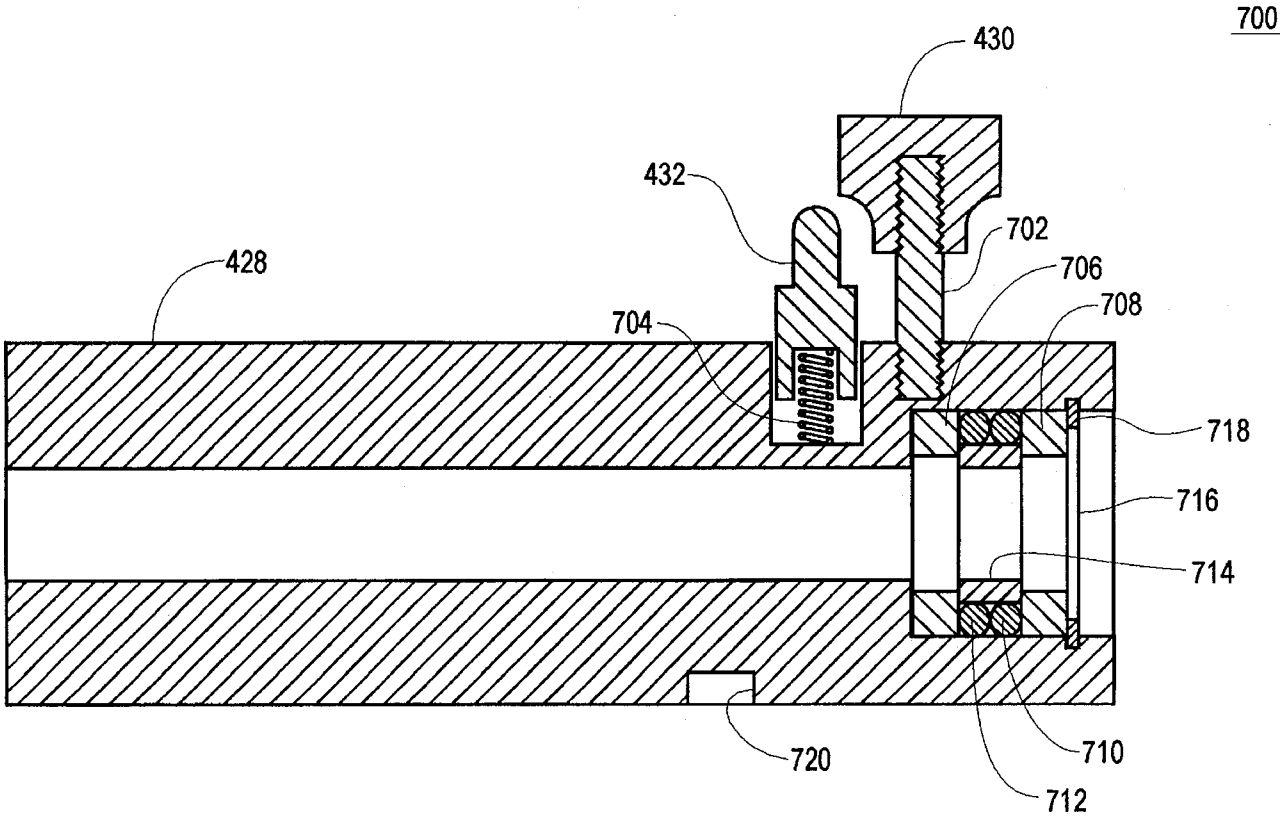

Reference is directed to FIGS. 7A and 7B. FIG. 7A is a section view of the slidable bolt assembly along its centerline. FIG. 7B is an end view of the slidable bolt assembly. In the second embodiment of the present invention, the slidable bolt assembly is spring biased by the main spring and is urged against the valve assembly upon actuation of the trigger. The resulting impact causes the valve to open and release compressed gas thereby expelling the projectile from the barrel. An important aspect of the slidable bolt assembly is its ability to seal against the loss of compressed gas between it and the barrel. This is accomplished by utilizing a compression sleeve within the slidable bolt assembly which is similar in structure to the compression sleeve in the barrel guide assembly in the first embodiment.

The slidable bolt assembly 700 includes a housing 428 which is formed from a suitable thermoplastic material. A hole is formed therethrough and the inside diameter is very slightly larger in diameter than the outside diameter of the barrel. The hole has an enlarged diameter at one end for retaining the compression sleeve assembly. The compression sleeve assembly includes first washer 706 and second washer 708. Between the washers 706 and 708 are two 'O'-rings 710 and 712 and compression sleeve 714. The 'O'-rings 710 and 712 apply radially inward force against the compression sleeve 714 and the barrel, not shown. This force serves to create a seal against the loss of compressed gas. The preferred material of the compression sleeve is Teflon, however other suitable thermoplastic material which exhibit good lubricity characteristics could also be used.

The compression sleeve assembly is retained into the housing 428 by a clip ring 716 which engages an annular groove 718 in housing 428. The outside diameter of the housing 428 is very slightly less than the inside diameter of the receiver tube. The foregoing arrangement of diameters, barrel to housing 428 and housing 428 to receiver tube serve to support the slidable breech assembly as is slide within the gun.

A cocking stem 702 is threaded into housing 428 and supports cocking knob 430. The cocking stem extends through the receiver tube, not shown, and allows manual access to the cocking knob 430. A hole 705 is recessed into housing 428 and receives anti-rebound lock 432 which is spring biased upwardly by spring 704. The anti-rebound lock 432 engages the lock opening 334/434 in the receiver tube 302/402. Anti-rebound lock 432 is retained from unlimited upward movement by a retaining pin, not shown. Other means for retaining upward movement could also be used. A cocking pawl 720 is machined into housing 428 for engaging the trigger assembly, not shown.

Figure 8B:
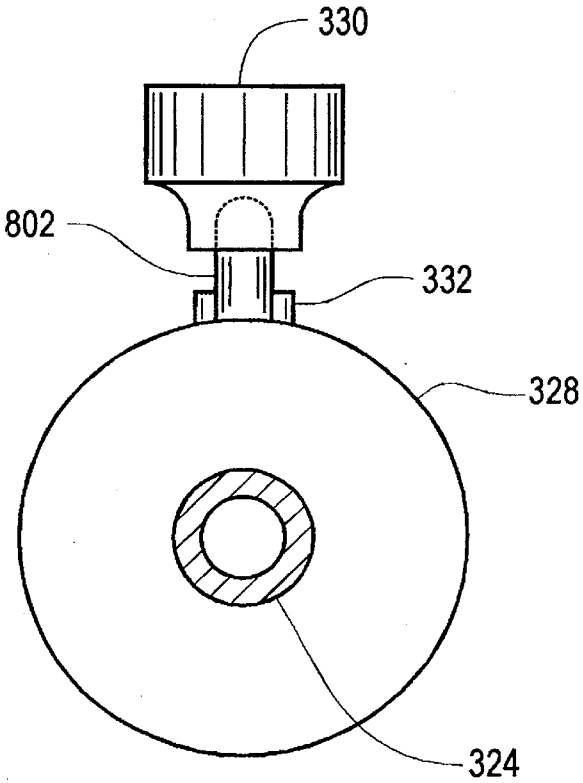
FIGS. 8A and 8B are details of the cocking pawl, cocking knob, and anti-rebound lock in the first embodiment.
Figure 8A:
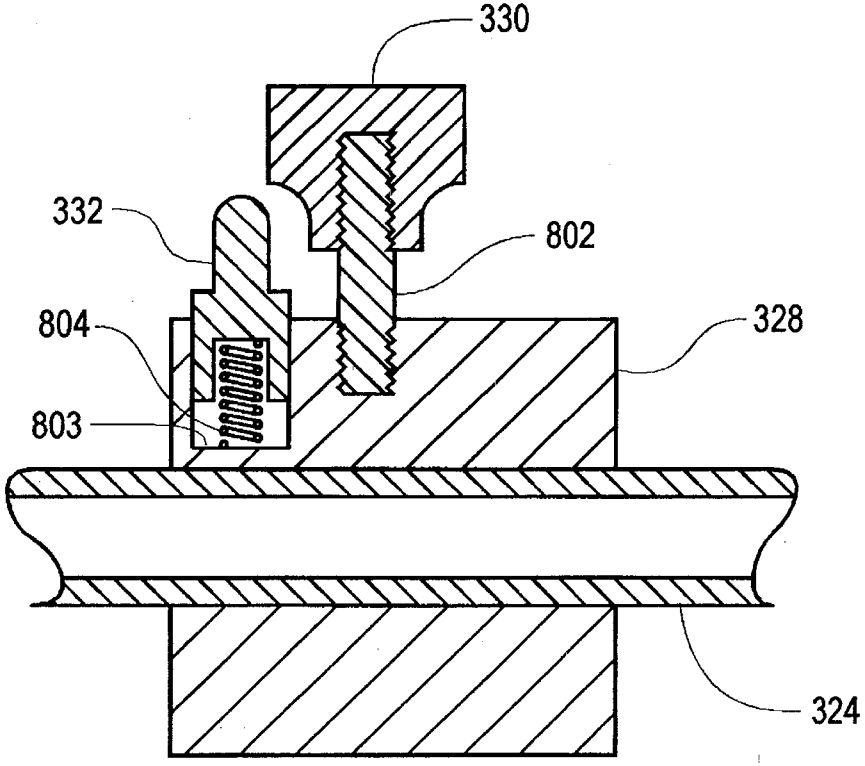

Reference is directed to FIGS. 8A and 8B which are details of the cocking pawl assembly 328 in the first embodiment of the present invention. FIG. 8A is a section view along the centerline of the cocking pawl and barrel. FIG. 8B is an end view of the cocking pawl, showing the barrel 324 in section view.

Cocking pawl 328 is cylindrical in shape and formed from a suitable rigid material. In the preferred embodiment, nylon is used, but any other suitable material is acceptable. The cocking pawl may b be press fit to barrel 324, or cemented, or attached by suitable fasteners such that its position relative to the barrel 324 is fixed. Cocking stem 802 is threaded into cocking pawl 328 and supports cocking knob 330. The cocking stem 802 extends through the lock opening 334, (not shown) in the receiver tube 302 and allows manual operation of the cocking knob 330. Cocking pawl 328 has a hole 803 formed therein for receiving anti-rebound lock 332 which is spring biased in an upward direction by spring 804. The anti-rebound lock 332 engages the lock opening 334 in the receiver tube 302. Anti-rebound lock 332 is retained from unlimited upward movement by a retaining pin, not shown. Other means for retaining upward movement could also be used.

Figures 9A, 9B, 9C:
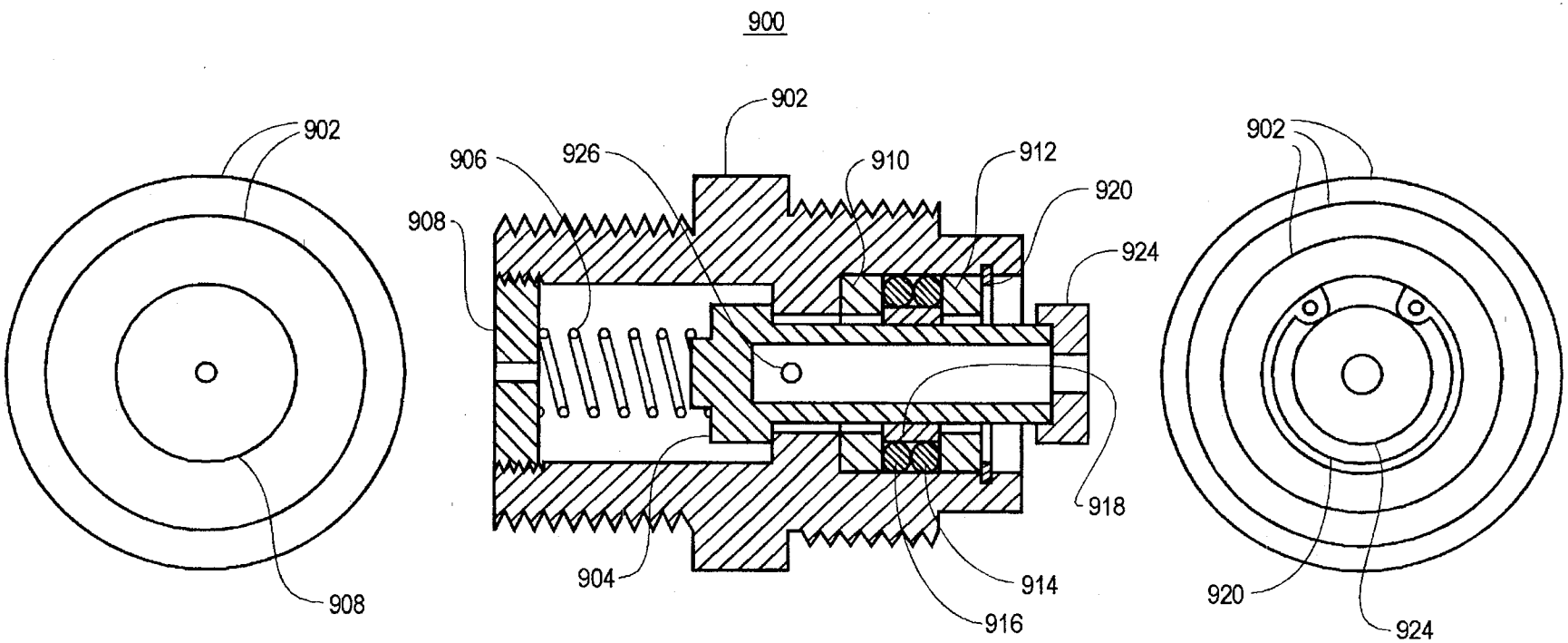
FIGS. 9A, 9B, and 9C are details of the first embodiment of the valve assembly.

Reference is directed to FIG. 9A which is detail of the first embodiment of the valve assembly 900. FIG. 9A is a section view taken along the centerline of the valve assembly 900. FIG. 9B is an end view of the inlet end of the valve assembly 900 and FIG. 9C is an end view of the discharge end of valve assembly 900.

Valve assembly 900 includes a housing 902 which is threaded on the exterior of the inlet end for coupling to the tank 102 and is also threaded on the exterior of the discharge end for coupling to the receiver tube 302/402 of the frame of the gun in both the first and second embodiments. A gas port 904 is inserted into a hole formed through the center of the housing 902. The gas port 904 is configured with a shoulder that seals against an internal flange formed in the hole in the housing 902. The gas port 904 is spring biased by spring 906 to a closed position. On the discharge end of gas port 904 is fitted an impact pad 924 which serves to engage the barrel 324 in the first embodiment and the slidable bolt assembly 428 in the second embodiment. Its purpose it to absorb some of the impact shock and prevent damage to the discharge end of gas port 904. The impact pad also serves to adjust the diameter of the gas port 904 to the barrel or slidable bolt assembly and provide a proper seal from the loss of gas upon actuation of the valve assembly.

The gas port opens, in operation, when the impact pad and valve port are driven toward the inlet end of the valve assembly 900 thusly allowing gas vent hole 926 to be exposed to the high gas pressure in the inlet end of the housing 902. After actuation, spring 906 forces the gas port 904 closed. Inlet plate 908 is threaded into the inlet end of the housing 902 and retains spring 906. Inlet plate 908 includes a hole which allows compressed gas to enter the inlet end of housing 902. It should be noted that the pressure of the compressed gas against gas port 904 aids in holding the valve in a closed position prior to actuation.

A seal assembly is provided to prevent the loss of compressed gas along the outside diameter of gas port 904 during actuation of the valve assembly. Such a loss of gas would reduce the projectile velocity and waste gas by allowing it to escape outside the breech end of the barrel or slidable bolt assembly. The seal includes a first and second washer 910 and 912, and two 'O'-rings 914 and 916. A compression sleeve 918 is radially biased against the gas port 904 by the compression of the 'O'-rings 914 and 916. This configuration is similar to the seal in the slidable bolt assembly described herein before. Again, thermoplastic materials are used and Teflon is preferred. The components of the seal assembly are retained by clip ring 920 which is inserted into an annular grove formed in housing 902.

Figures 10A, 10B, 10C:
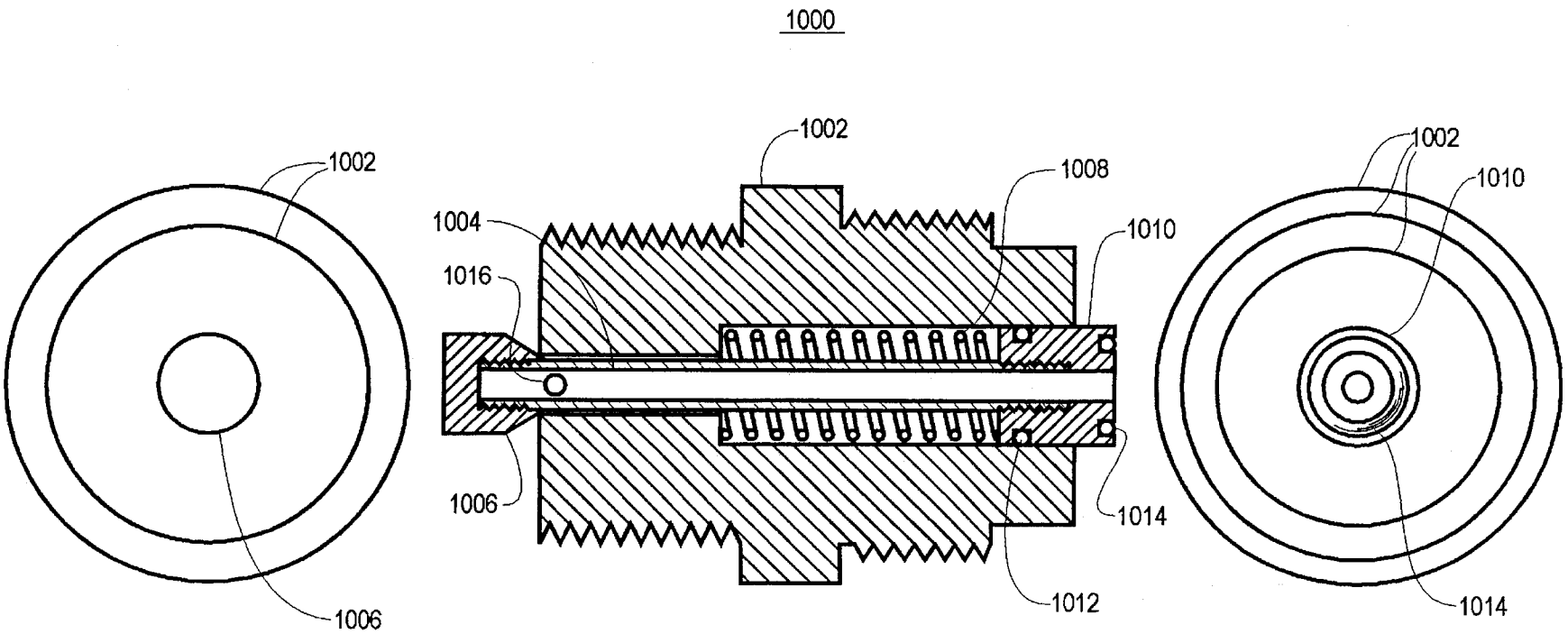
FIGS. 10A, 10B, and 10C are details of the second embodiment of the valve assembly.

Reference is directed to FIGS. 10A, 10B, and 10C which detail the second valve assembly in the present invention. FIG. 10A is a section view taken along the centerline of the valve assembly 1000. FIG. 10B is an end view of the inlet end of the valve assembly 1000. FIG. 10C is an end view of the discharge end of valve assembly 1000.

The valve assembly includes a housing 1002 that is threaded on its outside diameter on the inlet end for connecting to gas tank 102, not shown. The housing 1002 is threaded on the outside diameter of its discharge end for connection to the receiver tube 302/402 of the frame of the gun. A hole is formed through the housing 1002 along its centerline and serves as a passage for gas port tube 1004.

The inlet end of gas port tube 1004 is threaded to accept gas valve 1006 which seals against housing 1002 when the valve assembly is closed. The discharge end of gas port tube 1004 is threaded to accept plunger 1010. The plunger seals against the inside diameter of the hole formed in housing 1002 with an 'O'-ring that rests in an annular groove formed in plunger 1010. In addition, plunger 1010 has an 'O'-ring in a recessed groove on its discharge end for sealing against the barrel or slidable bolt assembly. A spring 1008 is disposed within the hole in housing 1002 and holds the valve assembly in a closed position by applying a force against plunger 1010.

In operation, valve assembly 1000 is actuated and opened when the barrel or slidable bolt assembly are driven against the discharged end of plunger 1010. This action causes the plunger 1010, gas port tube 1004 and valve 1006 toward the inlet end of the valve assembly. As this motion occurs, hole 1016 in the gas port tube is exposed to the high gas pressure on the inlet side of the valve assembly 1000 and allows gas to pass through the gas port tube and the plunger into the breech end of the barrel or slidable bolt assembly and expel the projectile as desired.

One aspect of the present invention is to provide for an improved compressed gas gun that is not only efficient, accurate and repeatable, but also minimizes the cost of producing it in volume production. It should be noted that the barrel guide assembly 320 and 322 in the first embodiment, the seal assembly in the slidable bolt assembly 428 and the seal assembly in the second embodiment of the valve assembly use common parts, including the washers, 'O'-rings and compression sleeves. It has been determined that this assembly is effective at allowing a linear sliding motion while providing both accurate alignment and positioning as well as a tight seal against the leakage of compressed gas. By utilizing common parts, the economies of scale are utilized effectively and the number of different parts in the gun is minimized.

I claim:

1. A compressed gas gun operable to be coupled to a compressed gas tank and for propelling a projectile under force of compressed gas expelled though an outlet fitting on the compressed gas tank, said air gun comprising:

a frame having a muzzle end and a breech end;

a first barrel guide, having a housing, attached to said frame at a point closer to said muzzle end than said breech end, and wherein said first barrel guide has a compression sleeve disposed between said housing and said barrel for supporting said barrel and allowing said barrel to slide with respect to said frame;

a second barrel guide attached to said frame at a point closer to said breech end than said first barrel guide;

a barrel having a breech and having a cocking pawl attached thereto, said barrel being slidable mounted along the longitudinal axis of said barrel by said first barrel guide and said second barrel guide;

a valve assembly having an inlet fitting for connecting to the outlet fitting on the compressed gas tank and having a gas port for expelling compressed gas upon actuation of said valve assembly, said valve assembly attached to said frame at a position aligning said gas port with said breech of said barrel;

a spring disposed between said frame and said barrel, exerting force to urge said barrel to slide toward said breech end of said frame thereby forcing said breech of said barrel to impact said valve assembly and seal against said gas port, and a trigger assembly attached to said frame and operable to engage said cocking pawl and retain said barrel at a position away from said valve assembly, and wherein activation of said trigger assembly releases said cocking pawl thereby allowing said spring to urge said barrel against said valve assembly, expelling compresses gas through said gas port, into said breech of said barrel, and propelling the projectile.

2. The compressed gas gun in claim 1, and wherein said barrel guide further comprises:

a radial biasing means disposed between said housing and said compression sleeve for urging said compression sleeve against said barrel.

3. The compressed gas gun in claim 2, wherein said radial biasing means is an 'O'-ring.

4. The compressed gas gun of claim 1, and wherein said compression sleeve is a split compression sleeve.

5. The compressed gas gun in claim 1, further comprising:

an anti-rebound lock disposed between said frame and said barrel and operable to prevent rebound of said barrel after actuation of said valve assembly.

6. The compressed gas gun in claim 5, and wherein said anti-rebound lock further comprises:

a lock member comprising a base portion and an extension portion, and wherein said cocking pawl has a hole formed therein for receiving said base portion of said lock member, and wherein said frame has an opening formed therein with an elongated portion and a wide portion and wherein said extension portion of said lock member engages said elongated portion of said opening and said base portion engages said wide portion of said opening, and further comprising a lock spring disposed between said cocking pawl and said lock member exerting a force against said lock member urging said lock member into said opening, and wherein actuation of said trigger assembly, causing said barrel to slide toward said breech end of said frame, allows said lock spring to force said base portion of said lock member to engage said wide portion of said opening thereby preventing subsequent rebound of said barrel.

7. The compressed gas gun in claim 1, and wherein said valve assembly further comprises:

a valve housing for attaching said valve assembly to said frame and to the tank;

a gas port having a valve end and a vent port at a vent port end, said gas port disposed within said housing and slidable between a closed position for preventing the flow of compressed gas and an open position for allowing the flow of compressed gas through said vent port;

a valve spring disposed between said valve housing and said gas port and urging said valve end of said gas port to close against said valve housing thereby preventing the flow of compressed gas;

a valve compression sleeve disposed between said valve housing and said gas port for supporting said gas port and allowing said gas port to slide with respect to said valve housing, and thereby sealing said gas port against the flow a compressed gas though other portions than said vent port, and an "o"-ring disposed between said valve housing and said valve compression sleeve for urging said valve compression sleeve against said gas port.

8. A compressed gas gun, comprising:

a frame having a muzzle end and a breech end;

a barrel having a breech and a muzzle, said barrel attached to said frame;

a slidable bolt assembly, having a housing and a compression sleeve disposed between said housing and said barrel for supporting said housing, slidably mounted to the breech end of said barrel and slidable along the longitudinal axis of said barrel, said slidable bolt assembly having a cocking pawl formed therein and a gas inlet opening;

a valve assembly having an inlet fitting for connecting to the outlet fitting on the compressed gas tank and having a gas port for expelling compressed gas upon actuation of said valve assembly, said valve assembly attached to said frame at a position aligning said gas port with said gas inlet opening of said slidable bolt assembly;

a spring disposed between said frame and said slidable bolt assembly so as to bias said slidable bolt assembly toward said breech end of said frame, and a trigger assembly attached to said frame and operable to engage said cocking pawl and retain said slidable bolt assembly at a position away from said valve assembly, and wherein activation of said trigger assembly releases said cocking pawl thereby allowing said spring to urge said slidable bolt assembly against said valve assembly, expelling compressed gas through said gas port, into said gas inlet opening of said slidable bolt assembly, and propelling the projectile.

9. The compressed gas gun in claim 8, and wherein said slidable bolt assembly further comprises:

a radial biasing means disposed between said housing and said compression sleeve for radially urging said compression sleeve against said barrel.

10. The compressed gas gun in claim 9, wherein said radial biasing means is an 'O'-ring.

11. The compressed gas gun of claim 8, and wherein said compression sleeve is a split compression sleeve.

12. The compressed gas gun in claim 8, further comprising:

an anti-rebound lock disposed between said frame and said slidable bolt assembly and operable to rebound of said slidable bolt assembly after actuation of said valve assembly.

13. The compressed gas gun in claim 12, and wherein said anti-rebound lock further comprises:

a lock member comprising a base portion and an extension portion, and wherein said slidable bolt assembly has a hole formed therein for receiving said base portion of said lock member, and wherein said frame has an opening formed therein with an elongated portion and a wide portion and wherein said extension portion of said lock member engages said elongated portion of said opening and said base portion engages said wide portion of said opening, and further comprising a lock spring disposed between said slidable bolt assembly and said lock member exerting a force against said lock member urging said lock member into said opening, and wherein actuation of said trigger assembly, causing said slidable bolt assembly to slide toward said breech end of said frame, allows said lock spring to force said base portion of said lock member to engage said wide portion of said opening thereby preventing subsequent rebound of said slidable bolt assembly.

14. The compressed gas gun in claim 8, and wherein said valve assembly further comprises:

a valve housing for attaching said valve assembly to said frame and to the tank;

a gas port having a valve end and a vent port at a vent port end, said gas port disposed within said housing and slidable between a closed position for preventing the flow of compressed gas and an open position for allowing the flow of compressed gas through said vent port;

a valve spring disposed between said valve housing and said gas port and urging said valve end of said gas port to close against said valve housing thereby preventing the flow of compressed gas;

a valve compression sleeve disposed between said valve housing and said gas port for supporting said gas port and allowing said gas port to slide with respect to said valve housing, and thereby sealing said gas port against the flow a compressed gas though other portions than said vent port, and an "o"-ring disposed between said valve housing and said valve compression sleeve for urging said valve compression sleeve against said gas port.

* * * * *